US005655714A

United States Patent [19]

Kieffer et al.

[11] Patent Number: 5,655,714

[45] Date of Patent: Aug. 12, 1997

[54] PIVOTABLE SYPHON TUBE

[75] Inventors: Joseph W. Kieffer; Scott R. Carpenter, both of Rogers, Minn.

[73] Assignee: Wagner Spray Tech Corporation, Minneapolis, Minn.

[21] Appl. No.: 351,801

[22] Filed: Dec. 8, 1994

[51] Int. Cl.[6] ..... B05B 7/30

[52] U.S. Cl. ..... 239/318; 239/340; 239/DIG. 14; 222/464.3

[58] Field of Search ..... 239/373, 369, 239/340, 337, 318, 317, 311, DIG. 14; 222/464.3, 464.1; 403/19; 285/39; 81/119, 121.1, 3.15

[56] References Cited

U.S. PATENT DOCUMENTS

| | | | |
|---|---|---|---|
| 580,437 | 4/1897 | Wagner . | |
| 1,514,107 | 11/1924 | Schutten . | |
| 1,544,600 | 7/1925 | Sammis . | |
| 1,735,784 | 11/1929 | Olson . | |
| 1,915,343 | 6/1933 | Williams . | |
| 2,051,518 | 8/1936 | Cunningham | 299/88 |
| 2,079,933 | 5/1937 | Fisher | 239/373 X |
| 2,128,494 | 8/1938 | Morrow | 221/51 |
| 2,132,035 | 10/1938 | Leipold | 299/97 |
| 2,256,902 | 9/1941 | Huthsing | 103/153 |
| 2,279,927 | 4/1942 | Noth | 222/464.1 |
| 2,508,597 | 5/1950 | Dalrymple | 220/57 |
| 2,556,180 | 6/1951 | Hamilton | 222/376 |
| 2,740,563 | 4/1956 | Jackson | 222/464 |
| 2,765,963 | 10/1956 | Langguth | 222/255 |
| 2,924,360 | 2/1960 | Samuel | 222/394 |
| 2,956,713 | 10/1960 | Kerley, Jr. | 222/464 |
| 3,088,680 | 5/1963 | Fulton | 239/337 |
| 3,211,349 | 10/1965 | Prussin | 222/394 |
| 3,233,793 | 2/1966 | Seaquist | 222/394 |
| 3,240,398 | 3/1966 | Dalton, Jr. | 222/193 |
| 3,401,842 | 9/1968 | Morrison | 222/181 |
| 3,412,937 | 11/1968 | Chamberlain | 239/142 |
| 3,545,488 | 12/1970 | Venus, Jr. | 222/376 |
| 3,714,967 | 2/1973 | Zupan | 239/318 |
| 4,019,661 | 4/1977 | Szabo | 222/376 |
| 4,174,071 | 11/1979 | Lau | 239/348 |
| 4,273,272 | 6/1981 | Blanc | 222/464 |
| 4,401,268 | 8/1983 | Pomponi, Jr. | 239/142 |
| 4,830,235 | 5/1989 | Miller | 222/464 |
| 5,119,974 | 6/1992 | Mann | 222/376 |
| 5,195,664 | 3/1993 | Rhea | 222/464 |

FOREIGN PATENT DOCUMENTS

| | | | |
|---|---|---|---|
| 559868 | 3/1957 | Italy | 239/340 |
| 344323 | 3/1960 | Sweden | 222/464.1 |

OTHER PUBLICATIONS

Exhibit A, pp. 1 and 2 of 2, dated prior to Dec. 8, 1994 and showing a syphon tube rotatable by gravity when the cup is tipped off vertical.

*Primary Examiner*—Lesley D. Morris

*Attorney, Agent, or Firm*—Faegre & Benson

[57] ABSTRACT

A spray gun assembly having a paint cup, a removable lid, a pivotable syphon tube unit rotatably secured to the lid and having an intake end located inside the paint cup, and a handle attached to the pivotable syphon tube unit exterior of the paint cup above the lid. The pivotable syphon tube unit is rotatable in the lid to permit manually positioning the intake end to the lower most region of the paint cup so that the intake end stays immersed in liquid when the spray gun assembly is tilted to a particular position.

19 Claims, 3 Drawing Sheets

102
133
141
141a
135
165
139
159
175
139a
160
176
130
170
138
123
128
142a
148
159
156
140
158
142
142b
120
124
147
146
151
157
153
144
122
126

PIVOTABLE SYPHON TUBE

BACKGROUND

This invention relates to the field of portable spray painting equipment, more particularly to a spray gun assembly having a pivotable syphon tube unit.

A common construction of a spray gun assembly employs a spray gun, a paint cup, a lid and a syphon tube. The syphon tube is routed through the center of the lid with an intake end located inside the paint cup. The syphon tube is rigid and has a bend in it so that the tube's intake end draws liquid from a lowermost region adjacent a sidewall of the paint cup. This construction requires that the assembly be held in a somewhat upright position so as to keep the intake end immersed in the liquid as the liquid level drops. If the prior art assembly is tilted too far from an upright position, or if the assembly is pointed in an improper direction, the assembly will fail to operate due to the intake end drawing air instead of liquid. This problem is especially evident when the assembly is used to paint an overhead surface, such as the upper portion of a wall or ceiling, where the assembly must be tilted backwards, and immediately thereafter painting a lower portion of the wall or floor where the assembly must be tilted forwards.

In these prior art devices, the intake end of the syphon tube was in a fixed angular position relative to the nozzle of the spray gun. This forced users either to refill the paint cup prematurely in order to assure that the intake end would stay submerged in the liquid when the assembly was tilted to a desired position, or to disassemble the assembly and reposition the intake end. This typically entailed locating a wrench, loosening the nut holding the syphon tube in place, taking the lid off the paint cup, grabbing the syphon tube (which may be covered with paint), turning the syphon tube so that the intake end points in a different direction, placing and securing the lid back on the paint cup, and tightening the nut so that the syphon tube is once again held rigidly in place.

Accordingly, a need exists for a simple device which is effective for changing the angular position of the intake end of the syphon tube within the paint cup relative to the direction that the spray gun is pointing without opening, loosening or disassembly of the spray gun assembly.

SUMMARY

To avoid the foregoing problems, the present invention provides a spray gun assembly having a pivotable syphon tube unit which allows a user to manually position an intake end of a syphon tube within a paint cup without opening, loosening, or taking apart the assembly.

The assembly can include a spray gun, such as a high volume low pressure spray paint gun. The assembly further preferably includes a paint cup having a closed bottom end, a side portion and an open top end. When liquid, such as paint, varnish, lacquer or stain, is present in the paint cup and the paint cup is tilted within a sprayable tilt range, the liquid collects by gravity in a lowermost region where the bottom end and side portion meet.

A removable lid is secured to the top end of the paint cup and a pivotable syphon tube unit is routed through the lid and into the paint cup. The pivotable syphon tube unit of the present invention has an open intake end which is selectively positionable in a range of circumferential positions adjacent where the bottom end and side portion meet. Depending upon the direction in which the assembly is tilted, any of these circumferential positions may form the lowermost region of the paint cup. An actuating means is connected to the pivotable syphon tube unit, allowing a user to manually position the intake end to the particular circumferential position corresponding to the lowermost region of the paint cup when the assembly is tilted to a particular desired position. By operating the actuating means, the intake end can be repositioned so that it remains submerged in the liquid as the level drops during spraying and as the assembly is desirably tilted in a new direction.

In the preferred embodiment, the pivotable syphon tube unit includes a syphon tube which has a radially outward bend directing it to a region adjacent the sidewall and bottom end of the paint cup when the lid is attached to the paint cup. The pivotable syphon tube unit passes through the center of the lid, and is rotatable about a central axis of the lid. The actuating means is preferably a handle attached to the pivotable syphon tube unit and extending exteriorly of the paint cup and lid. The handle has an extension on its lower surface which rides within a circular groove located on the top of the lid, so as to prevent the handle from unintentionally separating from the pivotable syphon tube unit.

DETAILED DESCRIPTION

Figure 1:
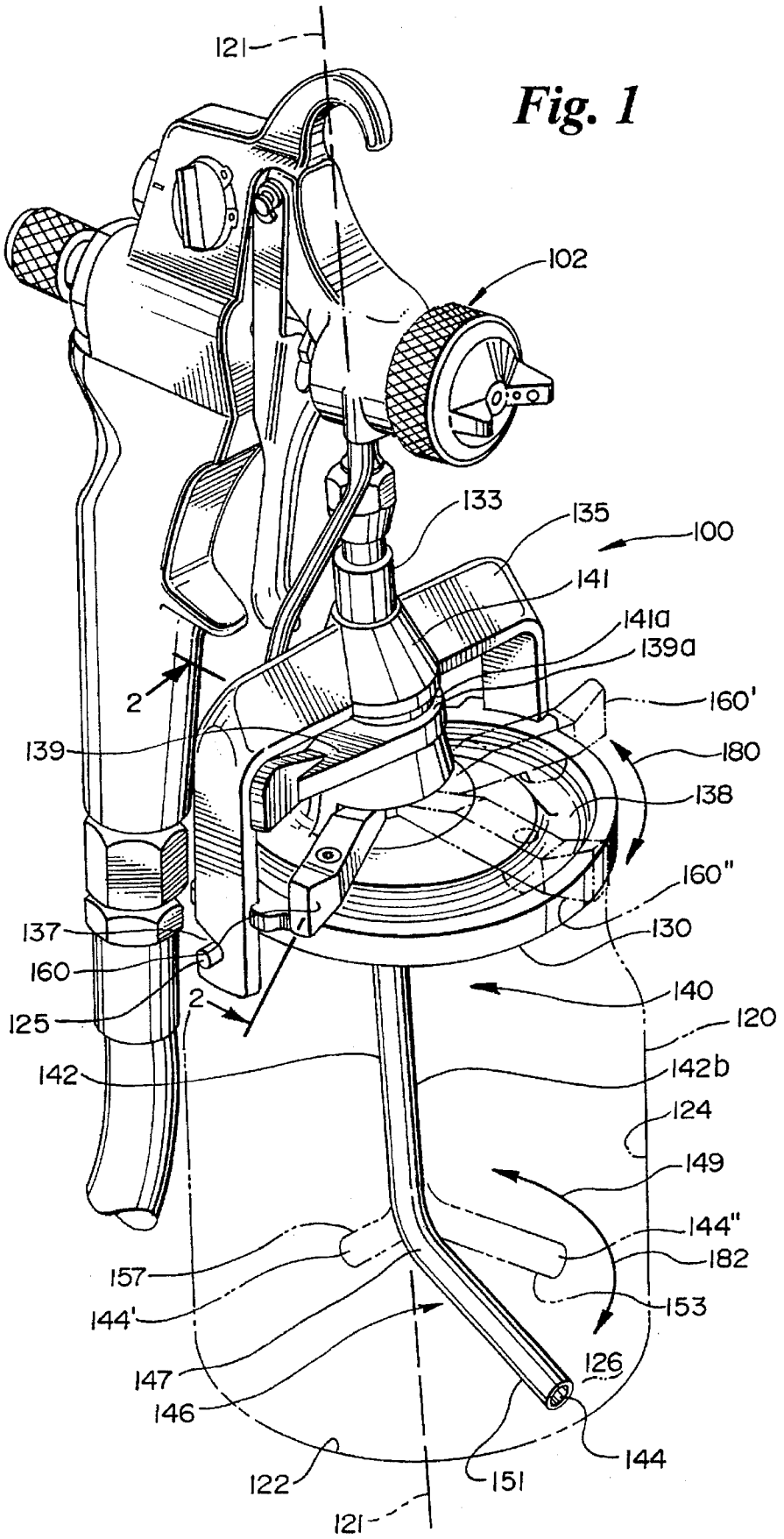
FIG. 1 is a perspective view of one embodiment of a spray gun assembly illustrating the present invention.
Figure 2:
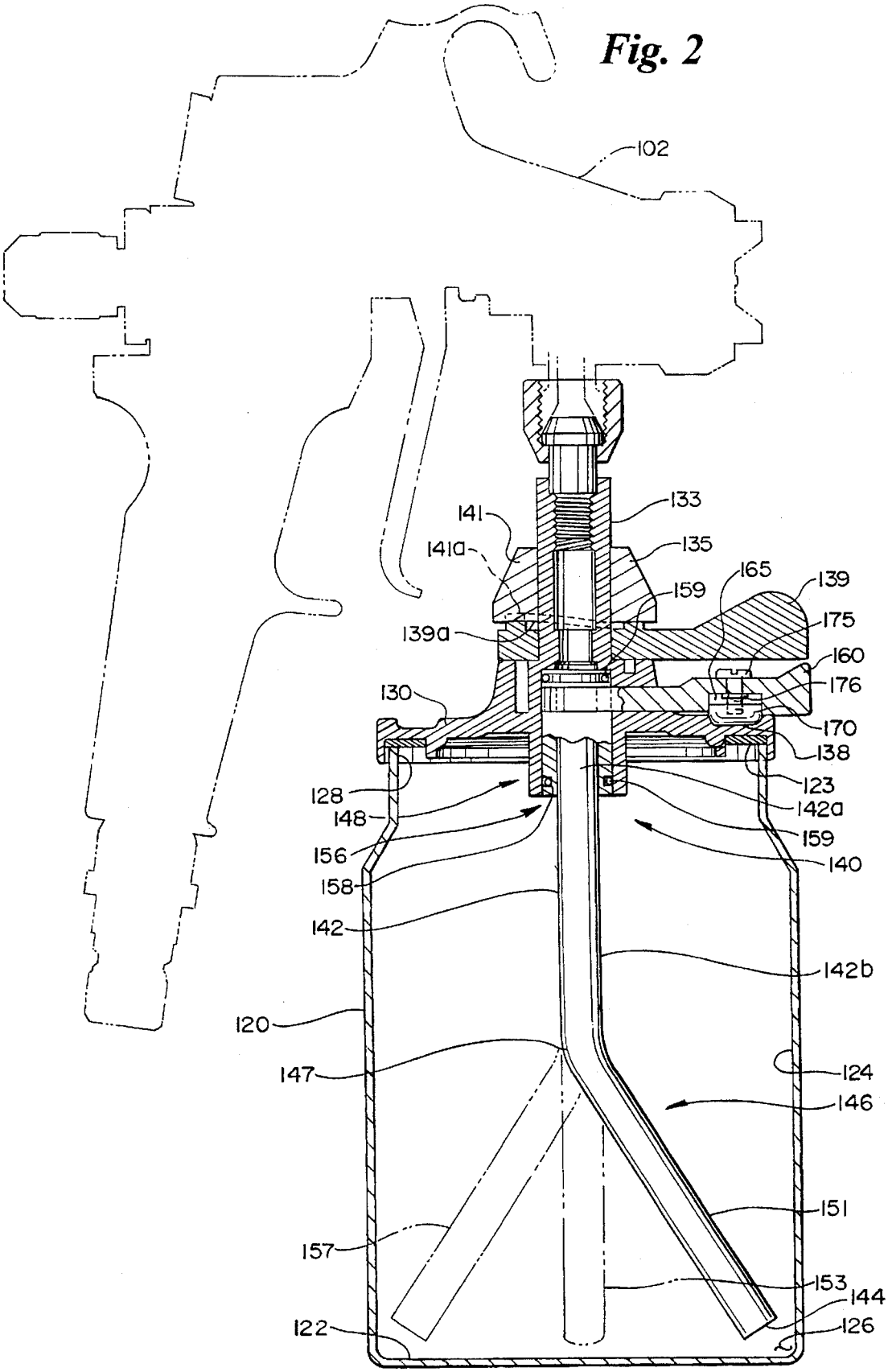
FIG. 2 is a section view taken along line 2—2 of FIG. 1, showing the spray gun in phantom.

Referring now to the figures and most particularly to FIGS. 1 and 2, a spray gun assembly 100 is shown. Assembly 100 is adapted to hold and deliver liquid via a spray gun 102 (which is to be understood to be part of assembly 100). The assembly 100 also includes a paint cup 120, a removable lid 130 secured to the paint cup 120, a pivotable syphon tube unit 140 and an actuating mechanism such as handle 160.

The pivotable syphon tube unit 140 has an upper portion 148 routed through the lid 130 and a lower portion 146 located in the paint cup 120. The upper portion 148 includes a rigid hollow upper syphon tube **142*a* for carrying liquid to the spray gun 102, and a pivoting mechanism such as bushing member 156 for pivotally connecting the pivotable syphon tube unit 140 to the lid 130. The lower portion 146 includes a rigid hollow lower syphon tube 142*b* having an intake end 144 at the lower end thereof for drawing liquid from the paint cup 120 and carrying to the upper syphon tube 142*a* and then to the spray gun 102. It is to be understood that the lower syphon tube 142b and the upper syphon tube 142a may be formed as integral portions of a unitary tube 142**.

The handle 160 is secured to the bushing member 156. Turning the handle 160 rotates the bushing member 156, which correspondingly moves the intake end 144 within the paint cup 120. The intake end 144 is preferably movable over a range 149 from a forward facing position 151 through a side facing position 153 to a rear facing position 157. For the purposes of clarifying further description of the spray gun assembly 100 but without intending to be unduly limited thereby, the remainder of this description will focus upon a preferred embodiment of this invention.

Construction

The paint cup 120 is preferably generally cylindrically shaped and has a longitudinal axis 121 oriented vertically when the paint cup 120 is in an upright position. The paint cup 120 has a closed bottom end 122, preferably in the form of a circular disk. Connected to and extending up from the bottom end 122 is a side portion 124, preferably in the form of a hollow, right circular cylinder. The side portion 124 and the bottom end 122 are sealed together in a liquid-tight fashion and adapted for retaining a liquid so that the liquid tends to flow by gravity towards the bottom end 122 whenever the paint cup 120 is tilted within a sprayable tilt range, defined to be whenever the spray gun assembly 100 is tilted up to about ±90 degrees away from the vertical. A lowermost region 126 is located inside the paint cup 120 proximate where the bottom end 122 and the side portion 124 meet, such that when the paint cup 120 is tilted within the sprayable tilt range, the liquid collects under gravity's force in the lowermost region 126. Paint cup 120 also has a rim 128 defining an open top end. It is to be understood that the paint cup 120 of this invention need not differ from those used in the prior art.

Figure 3:
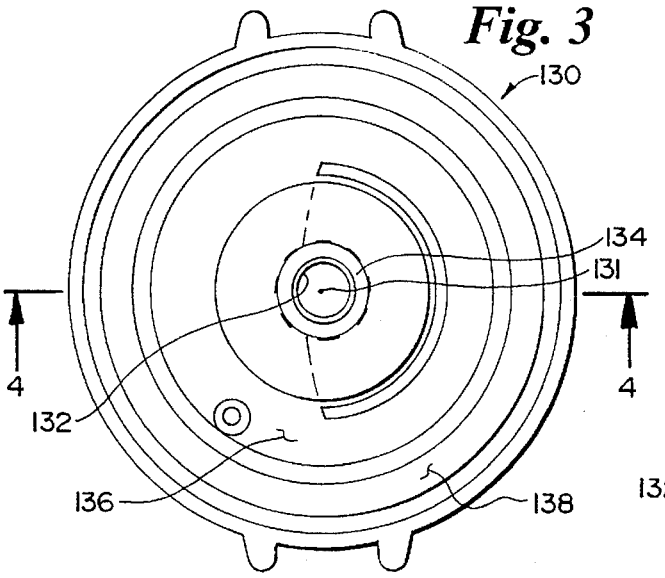
FIG. 3 is a top plan view of the lid of the spray gun assembly of FIG. 1.
Figure 4:
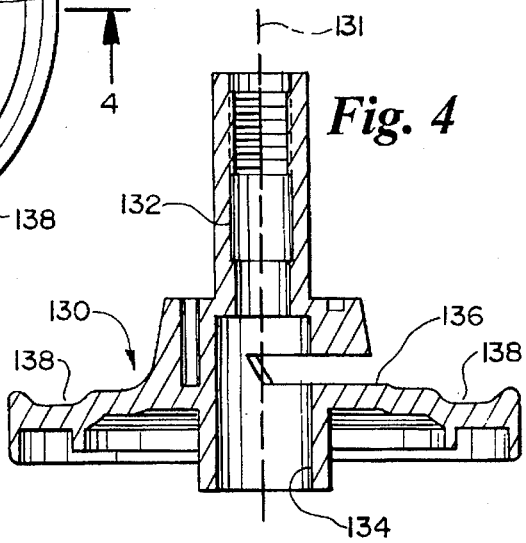
FIG. 4 is a section view of the lid taken along line 4—4 of FIG. 3.
Figure 5:
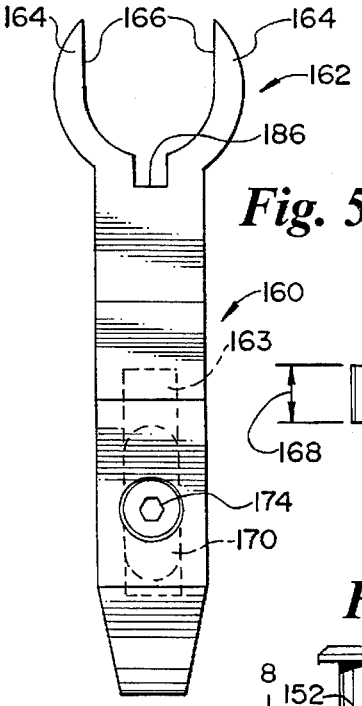
FIG. 5 is a top plan view of a handle for the spray gun assembly of FIG. 1.
Figure 6:
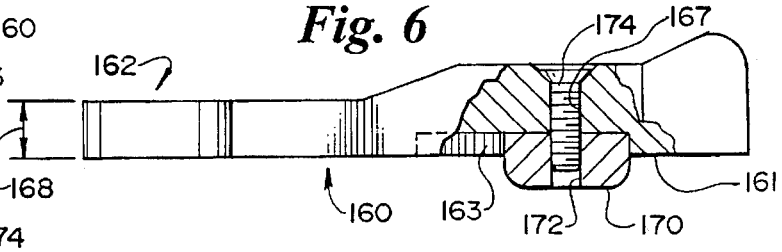
FIG. 6 is a right elevational view of an alternate embodiment of the handle with a portion cut-away to show details in section.

Referring now also to FIGS. 3 and 4, the lid 130 is removable and can be attached to the rim 128 at the top end of the paint cup 120, preferably with a seal 123 between them. The lid 130 has a central axis 131 coincident with the longitudinal axis 121 of the paint cup 120 when the lid 130 is attached to the paint cup 120. The lid 130 has a centered bore 134 in communication with a syphon opening 132, each of which is preferably cylindrically shaped. The lid 130 further has an upper structure 133 to which a spray gun 102 may be attached.

Referring again most particularly to FIGS. 1 and 2, the lid 130 may be detachably secured to the paint cup 120, in a manner similar to that of the prior art. In the embodiment shown, a bridge 135 is loosely retained by a collar 141 surrounding upper structure 133 and is free to slide vertically therealong. The bridge 135 has locking recesses 137 at the ends thereof, which are positioned to engage outwardly projecting locking lugs 125 located on the outside of side portion 124 of the paint cup 120. When the lid 130 is placed on the paint cup 120, the bridge 135 is positioned so that the locking recesses 137 fit over the locking lugs 125. The lid 130 further has a cam handle 139 which can be moved to raise the bridge 135, securing the lid 130 to the paint cup 120. It is to be understood that the lower surface 141a of the collar 141 and the upper surface 139a of the cam handle 139 have mating helical ramp-like surfaces opposing each other to urge the bridge 130 upward as the cam handle 139 is rotated in a direction forcing the ramp-like surfaces to drive the bridge 135 and the cam handle 139 axially apart.

Pivotably connected to the lid 130 is the pivotable syphon tube unit 140. The 140 has an upper portion 148 routed through the centered bore 134 of the lid 130 and a lower portion 146 located in the paint cup 120. The lower portion 146 includes a rigid hollow lower syphon tube 142b having a radially outward bend 147 with respect to the central axis 131. This radially outward bend 147 preferably forms an obtuse angle, facilitating easy cleaning and manufacture; alternatively it may be a gradual curve. The lower syphon tube 142b has an open intake end 144 at the lower end thereof adapted for drawing liquid from the paint cup 120. The radially outward bend 147 is designed so that the intake end 144 is located proximate the side portion 124 and the bottom end 122 and is able to be positioned in the lowermost region 126 of the paint cup 120 when the lid 130 is attached to the paint cup 120. The intake end 144 can be manually moved to various circumferential positions proximate the bottom end 122 and the side portion 124, as shown in phantom in FIGS. 1–2. When the assembly 100 is tilted to a particular position within the sprayable tilt range, the liquid will flow to the lowermost region 126. The intake end 144 can then be manually positioned to the lowermost region 126, such that it is immersed in the liquid.

Figure 7:
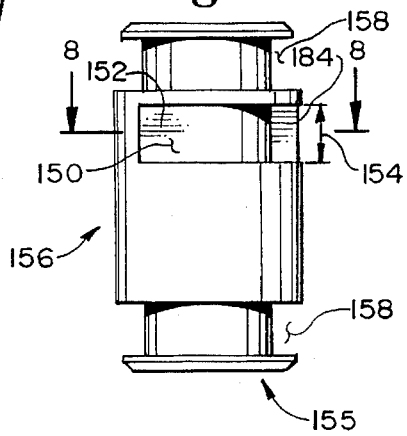
FIG. 7 is an elevational view of the bushing member of the spray gun assembly of FIG. 1.
Figure 8:
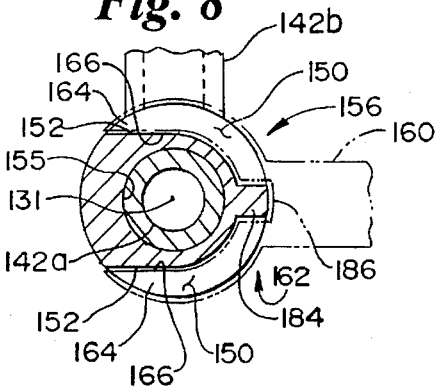
FIG. 8 is a section view of the bushing member taken along line 8—8 of FIG. 7 with a fragmentary view of the lower portion of the pivotable syphon tube unit, a section view of the upper portion of the pivotable syphon tube unit, and a phantom fragmentary view of the handle.

The upper portion 148 of the pivotable syphon tube unit 140 includes a rigid hollow upper syphon tube 142a and a pivoting mechanism such as an annular bushing member 156 for pivotally connecting the pivotable syphon tube unit 140 to the lid 130. The bushing member 156 fits coaxially around the upper syphon tube 142a and is secured thereto. FIG. 2 shows the syphon tube 142 and the bushing member 156 passing through the lid 130, and FIG. 7 shows the bushing member 156 in more detail. FIG. 8 shows a section view of the bushing member 156 and the upper syphon tube 142a along with a fragmentary view of the lower syphon tube 142b to illustrate the radial orientation between the handle 160 and the intake end 144. The handle 160 and the lower portion 146 extend radially outward from the central axis 131, and are preferably at an angle of substantially 90° relative to each other. In an alternate embodiment as illustrated in FIG. 2, the relative angular positions of the handle 160 and the lower portion 146 can be reset to angles 157, 151 other than 90° (shown at position 153) by rotating the syphon tube 142 relative to the bushing member 156.

The bushing member 156 allows the pivotable syphon tube unit 140 to be rotated in the centered bore 134 of the lid 130 about the central axis 131. The bushing member 156 carries a pair of O-rings 159 and fits into the centered bore 134 to form a seal therewith in order to prevent liquid from escaping. The bushing member 156 is preferably generally cylindrical, with a pair of O-ring grooves 158 at the ends thereof in which the O-rings 159 are received, as shown in FIG. 2. The bushing member 156 is preferably formed of a single piece of material, such as metal or plastic, and has a bore 155 sized to provide an interference fit therethrough with the upper syphon tube 142a to prevent relative movement between the upper syphon tube 142a and the bushing member 156 when press-fitted together.

Referring now particularly to FIGS. 5–8, the bushing member 156 further has a pair of recesses 150 designed to receive a mating end 162 of the handle 160. To assemble the pivotable syphon tube unit 140 to the lid 130, the upper portion 148 of the unit 140 is inserted up into the centered bore 134 of the lid 130, with the upper structure 133 preventing the unit 140 from being pulled upwards out of the centered bore 134. The mating end 162 of the handle 160 is then placed into engagement with the recesses 150 of the bushing member 156. Once the handle 160 is engaged with the member 156, the pivotable syphon tube unit 140 is prevented from being pulled downwards out of the centered bore 134.

The end 162 of the handle 160 has a pair of fingers 164. The fingers 164 have a pair of parallel opposed spaced-apart surfaces 166 which matingly fit a corresponding pair of parallel opposed spaced-apart surfaces 152 on the bushing member 156 in the recesses 150, forming a snug fit such that when the handle 160 is pivoted about the central axis 131, the pivotable syphon tube unit 140 is correspondingly rotated. The mating surfaces of the bushing member 156 and the handle 160 further have an interengaging tongue 184 and groove 186. The tongue 184 and groove 186 cooperate to further assist the handle 160 to turn the bushing member 156. The fingers 164 have a vertical thickness 168 and the recesses 150 have a vertical height 154 which are substantially equal to prevent the handle 160 from rocking vertically in the recesses 150.

Referring now again to FIGS. 1–6, the handle 160 has a lower surface 161 from which an extension 170 protrudes. The lid 130 has an upper surface 136 having a circular groove 138 therein concentric to the central axis 131. After the handle 160 is engaged with the bushing member 156, the extension 170 is assembled to the handle 160 to sit in the circular groove 138 and prevent the handle 160 from being pulled radially away from and out of the recesses 150. In one embodiment (shown in FIGS. 5 and 6), the handle 160 has both a threaded bore 167 through handle 160 and a recess 163 located on the lower surface 161 of the handle 160, in which the extension 170 is located. The extension 170 has a smooth bore 172 therein, and a threaded fastener 174 retains the extension 170 in alignment with the handle 160 when the handle and extension are installed in the spray gun assembly 100. Removing or withdrawing the fastener 174 releases the extension 170 from the handle 160, allowing the extension 170 to move along the recess 163 as the handle 160 is disengaged axially from the bushing member 156. In an alternative embodiment (shown in FIG. 2), the fastener 175 is retained to the handle 160 by, for example, a snap ring 176 and the extension 170 may be drawn upward into the recess 165 in the handle 160 and out of the circular groove 138, in order for the handle 160 to be pulled radially out of the recesses 150. Once the handle 160 is disengaged from the bushing member 156, the pivotable syphon tube unit 140 may be removed from the lid 130 to facilitate cleaning.

Operation

Referring now again to FIG. 1, once the handle 160 is connected to the bushing member 156, moving the handle 160 in the direction of the arrows 180 will rotate the pivotable syphon tube unit 140 about the central axis 131 and will correspondingly move the intake end 144 to particular circumferential positions within the paint cup 120 as indicated by the arrows 182. Alternate positions 160', 160" of the handle 160 are shown in FIG. 1. This allows an operator to manually position the intake end 144 to the lowermost region 126 without loosening or otherwise disassembling anything, so as to immerse the intake end 144 in the liquid when the assembly 100 is tilted within the sprayable tilt range. The handle 160 has a range of movement of approximately 140° since it is limited by the bridge 135, and thus enables where the intake end 144 can be positioned to reach the lowermost region 126.

The assembly 100 may be used to spray liquid such as paint, varnish, lacquer, or stain. Once liquid is poured into the paint cup 120, the lid 130 is placed on the paint cup 120 and secured thereto by rotating the cam handle 139. The operator notes the surface to be painted and the direction in which the assembly 100 must be tilted to easily paint this surface. The operator then pivots the handle 160 about the central axis 131 to position the intake end 144 in the lowermost region 126, submerging it in the liquid. If the operator chooses to change the direction in which the assembly 100 is to be tilted, the operator simply has to move the handle 160 to a new position which correspondingly moves the intake end 144 to a new lowermost region 126.

In FIG. 1, it is to be understood that moving handle 160 in the direction of the arrows 180 to position 160' will move the intake end 144 in the direction of the arrows 182 to position 144'. This position is suitable for spraying overhead surfaces when gun 102 must be tipped back, causing the lowermost region 126 to be in the back of cup 120, closest to the gun 102.

When the gun 102 is to be tilted forward for spraying, the handle 160 and the intake end 144 are desirably positioned as shown in solid in FIG. 1. The intake end 144 is thus positioned at the front of the paint cup 120, farthest from the gun 102.

When the gun 102 is to be tilted to the side for spraying in vertically confined spaces, the handle 160 is moved along arrows 180 to position 160", moving the intake end 144 to position 144" to draw paint or other liquid from a lowermost region 126 at a side of the paint cup 120.

The invention is not to be taken as limited to all of the details thereof as modifications and variations thereof may be made without departing from the spirit or scope of the invention.

What is claimed is:

1. A hand-held spray gun assembly having a spray gun and a pivotable syphon tube unit operable over a sprayable tilt range, the spray gun assembly comprising:

a paint cup having:

a closed bottom end;

a side portion connected to and extending up from the bottom end to an open top end and together with the bottom end adapted to retain liquid tending to flow by gravity towards the bottom end, wherein the paint cup is operable to retain the liquid when the paint cup is tilted within a sprayable tilt range; and a lowermost region located inside the paint cup proximate the bottom end and a lowest part of the side portion such that when the paint cup is tilted within the sprayable tilt range, liquid collects by gravity in the lowermost region;

a lid removably secured to the top end of the paint cup and having a bore therethrough;

a pivotable syphon tube unit passing through the bore of the lid and rotatably secured therein, the syphon tube unit including:

an upper portion rotatably connected to the lid and having a rigid hollow upper syphon tube for carrying liquid to a paint gun; and a lower portion located inside the paint cup and having a rigid hollow lower syphon tube with an intake end located proximate the bottom end and the side portion of the paint cup for drawing liquid from the paint cup;

sealing means positioned between the paint gun and the pivotable syphon tube for sealing an interface therebetween; and an actuating mechanism rigidly connected to the pivotable syphon tube unit for manually pivoting the intake end relative to the spray gun to draw liquid from the lowermost region of the paint cup when the spray gun assembly is tilted within the sprayable tilt range;

and wherein the lid has a central axis and the bore in the lid is centered about the central axis and the pivotable syphon tube unit is rotatable thereabout and the lower syphon tube further has a radially outward bend with respect to the central axis so that the intake end is located proximate the bottom end and the side portion of the paint cup;

and further wherein the actuating mechanism includes a handle rigidly connected to the upper portion of the pivotable syphon tube unit exterior of the paint cup above the lid, and further wherein the handle is pivotable about the central axis to rotate the pivotable syphon tube unit to position the intake end in the lowermost region of the paint cup.

2. The assembly of claim 1 further comprising a spray gun mounted to the lid and receiving the liquid from the paint cup via the pivotable syphon tube unit.

3. The assembly of claim 1 wherein the radially outward bend in the lower syphon tube forms an obtuse angle with respect to the central axis.

4. The assembly of claim 1 wherein the handle has a range of movement of approximately 140 degrees.

5. The assembly of claim 1 wherein the handle has an angular position relative to the intake end is approximately 90 degrees.

6. The assembly of claim 1 wherein the angular position of the handle relative to the intake end is adjustable.

7. The assembly of claim 1 wherein:

the handle has a pair of fingers extending from one end thereof forming a pair of parallel opposed spaced-apart surfaces; and the upper portion of the pivotable syphon tube unit has a corresponding pair of parallel opposed spaced-apart surfaces adapted to matingly receive the fingers of the handle.

8. The assembly of claim 7 wherein the upper portion of the pivotable syphon tube unit has a vertically extending recess for matingly receiving the fingers of the handle and securing the handle thereto, and the pair of fingers has a vertical height substantially equal to a height of the recess such that the handle is restrained from vertical movement in the recess.

9. The assembly of claim 8 wherein:

the lid has a circular groove on an upper surface thereof concentric to the bore of the lid; and the handle has an extension located on a lower surface thereof received in the groove such that the handle is restrained from radial movement with respect to the pivotable syphon tube unit.

10. The assembly of claim 9 wherein:

the extension is formed as a separate piece from the handle and has a threaded aperture therein; and the handle further has a smooth bore therethrough and a recess on the lower surface thereof, wherein the extension is retained within the recess.

11. The assembly of claim 10 further comprising a threaded fastener received in the smooth bore and threadedly engaged with the extension to retain the extension to the handle.

12. The assembly of claim 11 wherein the threaded fastener is operable to raise the extension into the recess on the lower surface of the handle to permit the handle to be withdrawn radially from the upper portion so that the pivotable syphon tube unit can be removed from the bore of the lid.

13. The assembly of claim 9 wherein:

the lid has an upper structure concentric to the central axis and located above the upper surface of the lid and having a reduced diameter bore therethrough which prevents the pivotable syphon tube unit from moving upward; and the upper portion of the pivotable syphon tube has an enlarged portion above the recess which retains the handle in the recess and prevents the pivotable syphon tube unit from moving downward.

14. The assembly of claim 9 wherein:

the extension is formed as a separate piece from the handle and has a threaded aperture therein; and the handle further has a smooth bore therethrough carrying a threaded fastener extending into the threaded aperture of the extension to removably secure the extension to the handle.

15. The assembly of claim 7 wherein the upper portion of the pivotable syphon tube unit includes an enlarged annular bushing member received over the upper syphon tube and carrying a sealing means for forming a liquid-tight seal between the upper portion of the pivotable syphon tube unit and the lid.

16. The assembly of claim 15 wherein the bushing member is formed of a single piece of material.

17. The assembly of claim 15 wherein the bushing member includes at least one O-ring groove and the sealing means includes an O-ring received in the O-ring groove.

18. The assembly of claim 15 wherein the handle and bushing member further comprise interengaging tongue and groove means for coupling the handle to the bushing member.

19. A method of repositioning an intake end of a syphon tube in a paint cup of a spray gun assembly relative to a spray gun of the spray gun assembly for operation within a sprayable tilt range comprising the steps of:

providing a spray gun assembly having sealing means positioned between the spray gun and the syphon tube for sealing an interface therebetween;

tilting the spray gun assembly to a desired angle to facilitate painting a desired surface; and manually moving an actuating mechanism external of the paint cup and connected to a syphon tube to a particular angular position with respect to the paint cup to orient an intake end of the syphon tube to a predetermined desired region of the paint cup such that the intake end is positioned at a lowermost region of the paint cup.

* * * * *